United States Patent [19]

Nakamura

[11] Patent Number: 5,001,506

[45] Date of Patent: Mar. 19, 1991

[54] PHOTOSENSITIVE MATERIAL PROCESSING SYSTEM

[75] Inventor: Takashi Nakamura, Minami-ashigara, Japan

[73] Assignee: Fuji Photo Film Co., Ltd., Kanagawa, Japan

[21] Appl. No.: 454,256

[22] Filed: Dec. 21, 1989

[30] Foreign Application Priority Data

Dec. 22, 1988 [JP] Japan ..... 63-323881
Dec. 23, 1988 [JP] Japan ..... 63-325519

[51] Int. Cl.[5] ..... G03D 3/02
[52] U.S. Cl. ..... 354/324; 354/322
[58] Field of Search ..... 354/320, 321, 322, 324; 430/398, 399, 400, 401

[56] References Cited

U.S. PATENT DOCUMENTS 2,770,179 11/1956 Dye et al. ..... 354/320
4,719,173 1/1988 Hahm ..... 354/324
4,907,023 3/1990 Koboshi et al. ..... 354/321

*Primary Examiner*—A. A. Mathews
*Attorney, Agent, or Firm*—Sughrue, Mion, Zinn, Macpeak & Seas

[57] ABSTRACT

In a system comprising a first processing route for a first color photosensitive material, typically negative film including a developing tank, a blix tank, and a washing tank, and a second processing route for a second color photosensitive material, typically color paper including a developing tank, a blix tank, and a washing tank, the first and second processing routes are arranged in juxtaposition. Their corresponding tanks are channeled such that (1) the blix solution from the blix tank of the second route is passed to the blix tank of the first route, (2) the color developer from the developing tank of the first route is passed to the developing tank of the second route, and (3) the wash water from the washing tank of the first route is passed to the washing tank of the second route. A used processing solution overflowing from one route is reused in a corresponding tank of the other route.

6 Claims, 2 Drawing Sheets

PHOTOSENSITIVE MATERIAL PROCESSING SYSTEM

This invention relates to a dual photosensitive material processing system, and more particularly, to such a system for wet processing two types of silver halide color photosensitive material.

BACKGROUND OF THE INVENTION

Silver halide color photosensitive material (often referred to as "color photosensitive material"), after exposure, is typically processed through a series of steps including color development, desilvering, water washing, and stabilization. It is a common practice to use a color developer for color development, a bleaching, bleach-fixing or fixing solution for desilvering, city water or ion-exchanged water for washing, and a stabilizing solution for stabilization. The respective solutions are typically adjusted to a temperature of 30° to 40° C. while the color photosensitive material is dipped in the solutions for respective processing purposes.

Commonly used types of color photosensitive material include picture-taking color photosensitive material (often referred to as "negative film") and color printing photosensitive material (often referred to as "color paper"). To develop these different types of color photosensitive material in a laboratory, separate automatic developing machines are used for the respective materials. Installation of two automatic processors for negative film and color paper inconveniently occupies a substantial space in small area photo laboratories and print corners.

One approach to space saving is disclosed in Japanese Patent Application Kokai (JP-A) Nos. 129747/1985 and 34759/1986 relating to "an automatic developing machine comprising in a machine housing, separate processing tanks for separately processing different types of photosensitive material, and processing tanks each for commonly processing the different types of photosensitive material, the tanks being joined together in an array."

JP-A No. 169162/1987 discloses "a method for processing silver halide color photographic photosensitive material using an automatic developing machine comprising at least a color developing tank, a processing tank including a bleaching tank, and a stabilizing tank substituting for water washing, said method comprising processing two types of silver halide color photographic photosensitive material having different iodine contents in processing tanks having substantially the same bleaching capacity, characterized by processing a photosensitive material having an iodine content of up to 0.3 mol % and a bromine content of up to 80 mol % among the two types of photosensitive material in a processing tank having a bleaching capacity for it for a time of up to 1 minute."

JP-A No. 52549/1987 discloses "a color photographic photosensitive material processing apparatus comprising at least two color developing tanks for processing different types of color photographic photosensitive material, a tank having a bleaching function, and a stabilizer tank, said apparatus being devoid of a washing tank for washing the photosensitive material with water flow."

The developing machines disclosed in JP-A Nos. 129747/1985 and 134759/1986 are designed mainly for processing of color negative film and color paper. Developing tanks are separately provided as processing tanks for the respective purposes, whereas a bleach-fixing tank, a stabilizing tank or the like is provided as a common processing tank serving for both the purposes. This design is effective in reducing the installation space. Since processing tanks for bleach-fixation, stabilization and the like subsequent to development are common, no satisfactory photographic properties are accomplished unless the composition of respective processing solutions such as a bleach-fixing solution and a stabilizer is carefully chosen. In fact, JP-A No. 134759/1986 discloses in Experiments 1 and 2 that stains and insufficient desilvering occur with some bleaching agents used, and that surface soiling occurs and silver sulfide forms with some stabilizer compositions. Also, surface soiling occurs and silver sulfide forms with most stabilizers at a processing temperature because the processing temperature is common to the different types of photosensitive material. These references pay no attention to the recycle of used processing solutions including color developing, bleach-fixing, and stabilizing solutions or the reduction of replenishing amounts therefor.

The method of JP-A No. 169162/1987 is intended for processing two types of silver halide color photographic photosensitive material having different iodine contents in a common bleach-fixing tank. This method is effective in reducing the installation space, but imposes complexity in that the halogen composition of color photosensitive material is limited and the processing time must be accurately controlled in order to accomplish satisfactory photographic properties. This reference pays no attention to the recycle of used processing solutions or the reduction of replenishing amounts therefor.

The apparatus disclosed in JP-A No. 52549/1987 is designed mainly for processing of color negative film and color paper. An automatic processor for color negative film and another automatic processor for color paper are disposed side by side such that an overflow from a developing tank of the other processor for color paper is transferred to a developing tank of the processor for color negative film as a replenisher. This design is not only effective in reducing the installation space, but also achieves some improvements in the replenishing amount reduction and the recycle of a used solution.

However, JP-A No. 52549/1987 refers to only a color developer in connection with the replenishment saving and solution reuse, but not to other processing solutions such as a bleach-fixing solution. Regarding the stabilizer, it discloses to direct an overflow of the stabilizer from a late stage tank to a former stage tank within the same color negative film processing section. For the color developer, the travel direction of an overflow of the color developer is limited to the direction of flow from the color paper developing tank to the color negative film developing tank. This is still insufficient in replenishment saving and solution reuse. The amount of a replenisher required for a color negative film developer is generally large as compared with the amount of a replenisher for a color paper developer. Thus, the limited direction of overflow from the color paper developing tank to the color negative film developing tank indicates that the amount of a replenisher for the color paper developer should be unnecessarily increased in order to provide an optimum amount of replenishment to the color negative film developing tank.

If the direction of overflow were reversed for the purposes of used solution recycle and replenishment reduction, no satisfactory photographic properties would be available for the color paper for the following reason. Most often, the silver halide constituting the color negative film is silver iodobromide and the silver halide constituting the color paper is silver chlorobromide. Therefore, the overflow from the negative film developing tank contains the compound which is dissolved away from the color negative film and will deleteriously affect the processing of the color paper.

SUMMARY OF THE INVENTION

A primary object of the present invention is to provide a novel and improved photosensitive material processing system which can reduce the amount of replenishment, reuse an overflow in an efficient manner, and reduce the installation space while maintaining satisfactory photographic properties.

The present invention provides a system for wet processing an exposed silver halide color photosensitive material by carrying the photosensitive material along a processing route including a developing tank and a processing tank having a fixing function. More particularly, the system includes (1) a first processing route for a first color photosensitive material including a developing tank containing a color developer, a processing tank containing a processing solution having a fixing function, and a washing tank containing wash liquid, and (2) a second processing route for a second color photosensitive material including a developing tank containing a color developer, a processing tank containing a processing solution having a fixing function, and a washing tank containing wash liquid. The first and second processing routes are arranged in juxtaposition. According to the present feature, the system includes (A) transfer means for passing the processing solution from the processing tank of the second processing route to the processing tank of the first processing route. Preferably, the system further includes (B) transfer means for passing the color developer from the developing tank of the first processing route to the developing tank of the second processing route. This preferred embodiment is applicable to a situation wherein the first color photosensitive material has at least one silver iodobromide emulsion layer and the second photosensitive material has at least one silver chlorobromide or silver chloride emulsion layer.

According to the present feature, the system includes (C) transfer means for passing the wash liquid from the washing tank of the first processing route to the washing tank of the second processing route. Transfer means (A) and (B) may be incorporated in this embodiment.

In one preferred embodiment of the present invention, the first section or route (negative film processing route) for processing a picture-taking color photosensitive material having at least one silver iodobromide emulsion layer (negative film) is provided, which preferably includes a developing tank filled with a color developer for developing the photosensitive material (negative film developing tank), a processing tank having a fixing function in the form of a bleach-fixing tank for bleaching and fixing the photosensitive material (negative film bleach-fixing tank), a washing tank for washing the photosensitive material with water (negative film washing tank), and any other necessary tanks consecutively arranged for serial travel of the photosensitive material. The second section or route (color paper processing route) for processing a printing photosensitive material having at least one silver chlorobromide or silver chloride emulsion layer (color paper) is provided, which preferably includes a developing tank filled with a color developer for developing the photosensitive material (color paper developing tank), a processing tank having a fixing function in the form of a bleach-fixing tank for bleaching and fixing the photosensitive material (color paper bleach-fixing tank), a washing tank for washing the photosensitive material with water (color paper washing tank), and any other necessary tanks consecutively arranged for serial travel of the photosensitive material. The first or negative film processing route is juxtaposed to the second or color paper processing route in a side-by-side relationship.

The picture-taking color photosensitive material or color negative film is processed through the first or negative film processing route whereas the printing photosensitive material or color paper is processing through the second or color paper processing route. An overflow of the color developer from the negative film developing tank is channeled to the paper developing tank as a substitute for the mother color developer. In the running process, an overflow of the color developer from the negative film developing tank is channeled to the paper developing tank as a replenisher. This ensures full use of the overflowing color developer without a substantial deterioration of the overflow.

In addition, an overflow of the bleach-fixing solution from the color paper bleach-fixing tank is channeled to the negative film bleach-fixing tank as a substitute for the mother bleach-fixing solution. A bleaching ingredient or ingredients may be added to the overflow if desired. In the running process, an overflow of the bleach-fixing solution from the color paper bleach-fixing tank is channeled to the negative film bleach-fixing tank as a replenisher. Also, a bleaching ingredient or ingredients may be added to the overflow if desired. This ensures full use of the overflowing bleach-fixing solution.

Further, an overflow of the wash water from the negative film washing tank is channeled to the color paper washing tank as a substitute for the mother wash water. In the running process, an overflow of the wash water from the negative film washing tank is channeled to the color paper washing tank as a replenisher. This ensures full use of the overflowing wash water, resulting in a saving of wash water.

In this way, any overflows of color developer, bleach-fixing solution, and wash water each from one processing route can be efficiently recycled to the other processing route while reducing the amount of additional replenishers therefor. The photosensitive materials are processed to better photographic properties. The system requires only a reduced space for its installation.

BRIEF DESCRIPTION OF THE ACCOMPANYING DRAWINGS

The above and other objects, features, and advantages of the present invention will be better understood from the following description taken in conjunction with the accompanying drawings, in which:

FIGS. 1*a*, 1*b*, and 1*c* illustrate a photosensitive material processing system according to one preferred embodiment of the present invention, FIG. 1*a* being a schematic plan view, FIG. 1*b* being a schematic vertical cross section of the color negative film processing route, and FIG. 1*c* being a schematic vertical cross section of the color paper processing route; and

DESCRIPTION OF THE PREFERRED EMBODIMENTS

Figure 1A:
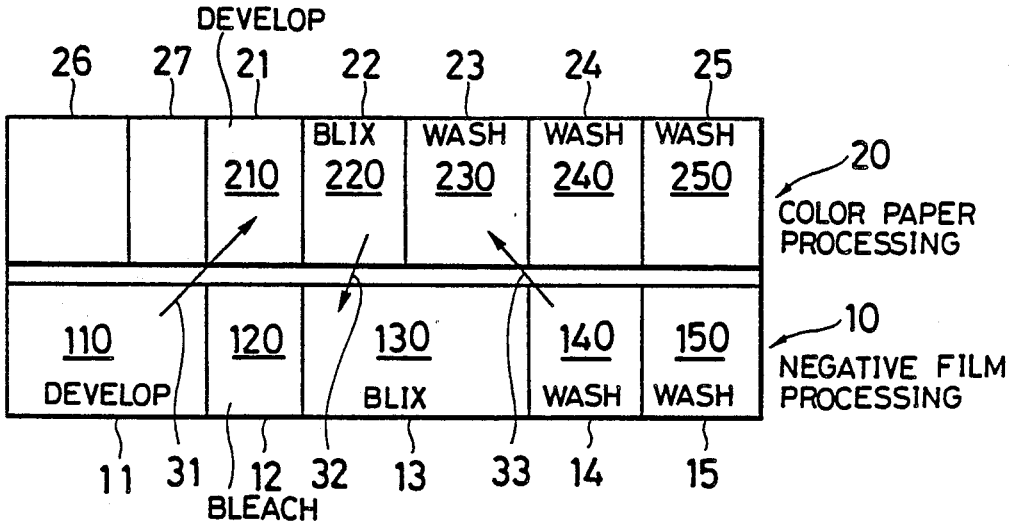
Figure 1B:
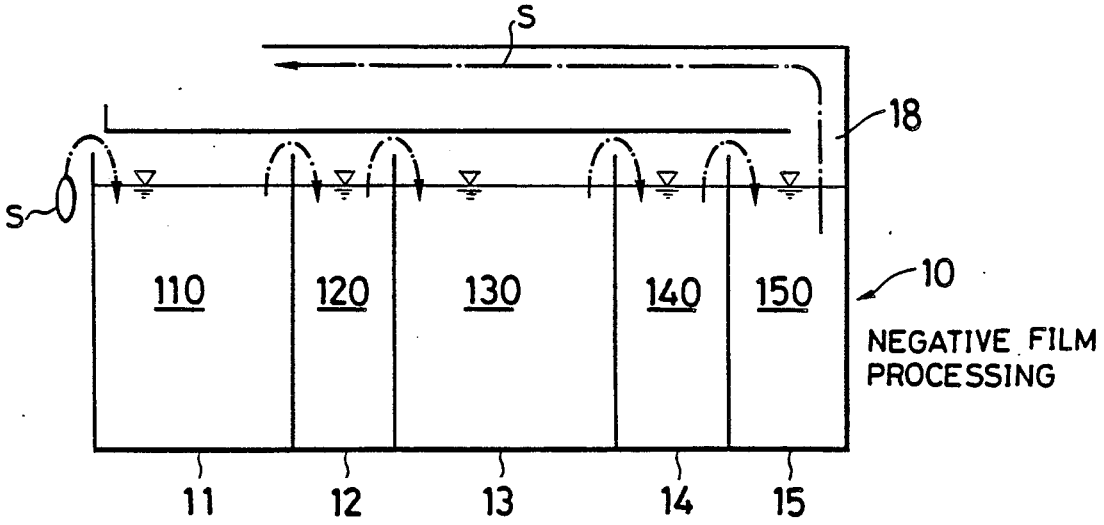
Figure 1C:
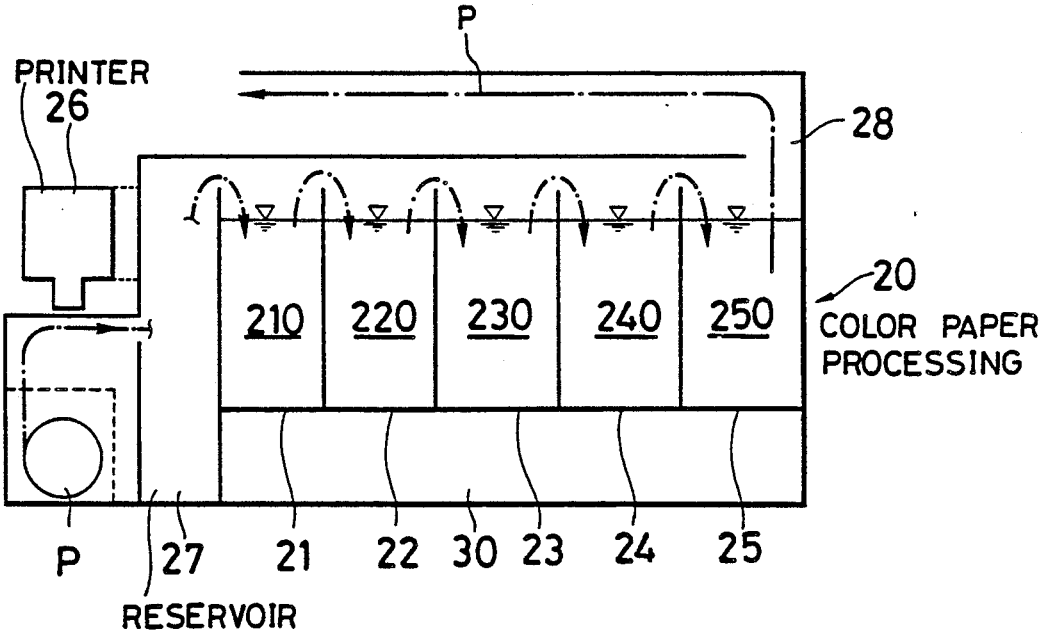

Referring to FIGS. 1*a*, 1*b*, and 1*c*, there is illustrated a photosensitive material processing system according to one preferred embodiment of the present invention. The system is illustrated as having a printer for contact printing built therein.

The photosensitive material processing system includes a first or negative film processing route (or section) 10 for conducting necessary steps including color development, bleaching, bleach-fixation, washing, and drying on a picture-taking color photosensitive material or negative film S, and a second or color paper processing route (or section) 20 for conducting necessary steps including color development, bleach-fixation, washing, and drying on a printing color photosensitive material or color paper P. Prior to the respective processes, the picture-taking color photosensitive material or negative film S has been exposed, and the printing color photosensitive material or color paper P has been contact printed using the processed negative film S. The negative film processing route 10 and the paper processing route 20 are juxtaposed side by side. The juxtaposed arrangement of the negative film and paper processing routes 10 and 20 minimizes the space required for the installation of the system.

The picture-taking color photosensitive material or negative film S has at least one silver iodobromide emulsion layer. The printing color photosensitive material or color paper P has at least one silver chlorobromide or silver chloride emulsion layer. In the case of the silver chlorobromide emulsion layer, it preferably contains at least 80 mol % of silver chloride. The construction of these photosensitive materials will be described later in detail.

In one illustrated embodiment, the negative film processing route 10 for the purpose of processing a length of picture-taking color photosensitive material or negative film S includes a developing tank (or negative film developing tank) 11 filled with a color developer 110 for developing the negative film, a bleaching tank 12 filled with a bleaching solution 120, a bleach-fixing tank (or negative film bleach-fixing-tank) 13 filled with a bleach-mixing solution 130, first and second washing tanks (or negative film washing tanks) 14 and 15 filled with wash water 140 and 150, and a drying chamber 18 for drying the washed negative film S as shown in FIG. 1*b*. The tanks are consecutively arranged and provided with guide means (not shown) such that the length of negative film may continuously travel from the developing tank 11 to the drying chamber 18 in the illustrated order as shown by phantom arrows.

The color paper processing route 20 for the purpose of processing a length of color printing photosensitive material or color paper P includes a printer 26 for contact printing from negative film S to color paper P, a reservoir 27 for directing the printed color paper P to a color developing tank 21 while controlling the rate of travel throughout the process, the developing tank (or paper developing tank) 21 filled with a color developer 210, a bleach-fixing tank (or paper bleach-fixing tank) 22 filled with a bleach-fixing solution 220, first, second, and third washing tanks (or paper washing tanks) 23, 24, and 25 filled with wash water 230, 240, and 250, and a drying chamber 28 for drying the washed color paper P as shown in FIG. 1*c*. The tanks are consecutively arranged and provided with guide means (not shown) such that the length of color paper may continuously travel from the developing tank 21 to the drying chamber 28 in the illustrated order as shown by phantom arrows.

The negative film processing route 10 is juxtaposed to the color paper processing route 20 in a side-by-side relationship as shown in FIG. 1*a*.

According to the present invention, transfer means 31 is preferably provided for allowing an overflow of the color developer 110 from the negative film developing tank 11 of the negative film processing route 10 to flow into the paper developing tank 21 of the paper processing route 20 as a mother and subsequently, as a replenisher (during the running process) for the color paper developer 210. In FIG. 1*a*, the transfer means 31 is illustrated in a simplified manner by an arrow indicative of the direction of flow. The transfer means 31 may be a conduit or channel extending between an overflow port (not shown) of the negative film developing tank 11 and an inlet port (not shown) of the color paper developing tank 21.

According to the present invention, transfer means 32 is provided for allowing an overflow of the bleach-fixing solution 220 from the paper bleach-fixing tank 22 of the color paper processing route 20 to flow into the negative film bleach-fixing tank 13 of the negative film processing route 10 as a mother and subsequently as a replenisher (during the running process) for the negative film bleach-fixing solution 130. In FIG. la, the transfer means 32 is illustrated in a simplified manner by an arrow indicative of the direction of flow. The transfer means 32 may be a conduit or channel extending between an overflow port (not shown) of the color paper bleach-fixing tank 22 and an inlet port (not shown) of the negative film bleach-fixing tank 13. The transfer means 32 may be a conduit with or without positive feed means. If desired, a bleaching ingredient or ingredients may be added to the overflow of the bleach-fixing solution being transferred from the paper bleach-fixing tank 22 to the negative film bleach-fixing tank 13. In this case, the transfer means 32 may preferably be provided with an intermediate sump where the bleaching ingredients are added to the bleach-fixing solution overflow being temporarily reserved.

According to the present invention, transfer means 33 is provided for allowing an overflow of the wash water 140 from the negative film washing tank 14 of the negative film processing route 10 to flow into the paper washing tank 23 of the paper processing route 20 as a mother and subsequently as a replenisher (during the running process) for the wash water 230. In FIG. 1*a*, the transfer means 33 is illustrated in a simplified manner by an arrow indicative of the direction of flow. The transfer means 33 may be a conduit or channel extending between an overflow port (not shown) of the negative film washing tank 14 and an inlet port (not shown) of the color paper washing tank 23.

In the negative film processing route 10, a communication port (not shown) is provided in the partition between the first and second washing tanks 14 and 15 such that the wash water 150 overflowing from the washing tank 15 at the later stage enters the washing tank 14 at the former stage. Similarly, in the color paper processing route 20, communication ports (not shown) are provided in the partitions between the second and third washing tanks 24 and 25 and between the first and second washing tanks 23 and 24 such that the wash water 250 overflowing from the washing tank 25 at the later stage enters the washing tank 24 at the intermediate stage and the wash water 240 overflowing from the washing tank 24 at the intermediate stage enters the washing tank 23 at the former stage.

It is to be noted that only color paper P is illustrated beneath the printer 26 in FIG. 1*c* with negative film S omitted for convenience of illustration. In actual contact printing, negative film S and color paper P are laid with their effective layers in close contact while color paper P is exposed to light through negative film S.

In addition to the above-illustrated components, the system of the invention typically includes make-up tanks (not shown) disposed in the negative film and color paper processing routes 10 and 20 each for replenishing a color developer, bleaching solution, bleach-fixing solution or wash water as required.

These make-up tanks and the sumps in which the overflowing solutions are temporarily stored for composition adjustment or other purposes may be provided in a space 30 left below the tank array of the paper processing section 20 as shown in FIG. 1*c*. Since the amounts of respective solutions used in color paper processing are smaller than those used in negative film processing, the respective tanks in the color paper processing section 20 can be of a smaller volume leaving the space 30 beneath the tank array. This results in a more compact structure.

The system further includes feeder means for directing the negative film S which has been processed through the negative film processing route 10 to the printer 26 of the paper processing route 20 though not shown in the figures.

The operation of the system is now described. The negative film S is serially transferred through the developing tank 11, bleaching tank 12, bleach-fixing tank 13, and washing tanks 14 and 15 along the negative film processing route 10 as shown by phantom arrows in FIG. 1*b* where the film is consecutively subject to color development, bleaching, bleach-fixation, and water washing. Thereafter, the film S is passed through the drying chamber 18 for drying.

The thus processed negative film S is then delivered to the printer 26 of the paper processing route 20 where contact printing of color paper P from negative film S is effected. The color paper P is serially transferred, at a controlled rate dictated by the reservoir 27, through the developing tank 21, bleach-fixing tank 22, and washing tanks 23, 24, and 25 along the paper processing route 20 as shown by phantom arrows in FIG. 1*c* where the color paper is consecutively subject to color development, bleach-fixation, and water washing. Thereafter, the paper P is passed through the drying chamber 28 for drying.

In the running operation, an overflow of the color developer 110 in the negative film processing route 10 is channeled to the paper developing tank 21 of the paper processing route 20 as a replenisher. An overflow of the wash water 140 in the negative film processing route 10 is channeled to the first washing tank 23 of the paper processing route 20 as a replenisher. An overflow of the used paper bleach-fixing solution 220 in the paper processing route 20 is channeled to the negative film bleach-fixing tank 13 of the negative film processing route 10, with bleaching ingredients being added if necessary. Preferably, wash water is passed in a counterflow manner between washing tanks 14 and 15 of the negative film processing route 10 and between washing tanks 23, 24, and 25 of the paper processing route 20. The illustrated embodiment implements two stage counterflow in the negative film processing route 10 and three stage counterflow in the paper processing route 20. Two to four stage counterflow modes are often preferred for water washing.

It is unnecessary to specially prepare the color developer 210 and wash water 230 for color paper and the bleach-fixing solution 130 for negative film because overflows of the color developer 110 and wash water 140 for negative film and an overflow of the bleach-fixing solution 220 for color paper having bleaching ingredients added thereto if necessary are fed to the paper developing tank 21, paper washing tank 23, and negative film bleach-fixing tank 13, respectively. This will be described in further detail.

It is unnecessary to specially prepare both a mother and a replenisher of the color developer 210 for color paper because an overflow of the color developer 110 for negative film is passed to the paper developing tank 21. It is only necessary to prepare a mother and a replenisher of the color developer 110 for negative film in the negative film processing route 10. The amount of color developer replenished is thus reduced for the entire system and at the same time, an overflow of the color developer 110 is reused.

The amount of color developer replenished per total of a 135-size 24-frame color negative film and a corresponding color paper is about 40 to 50 ml compared to 80 to 100 ml required in the conventional system. This replenisher amount is about 40 to 65% of that of the prior art.

The overflow can be utilized in the next destination without a substantial deterioration because it is directly fed to the destination.

If desired, it is possible to add necessary ingredients such as a color developing agent and alkaline agent to an overflow of the color developer 110 to prepare a mother or replenisher rather than directly using the overflow as a mother or replenisher for color paper P. This can further improve the photographic properties of color paper and reduce the developing time. To this end, a provision is made to the system such that the overflow of the color developer 110 in the film developing tank 11 may be once stored in a suitable sump where the necessary ingredients are added to prepare a mother or replenisher which is passed or channeled to the paper developing tank 21.

Similarly, it is unnecessary to specially prepare both a mother and a replenisher of the bleach-fixing solution 130 for negative film in the negative film processing section 10 because an overflow of the bleach-fixing solution 220 for color paper in the color paper processing section 20 is passed to the bleach-fixing tank 13. It is only necessary to prepare a mother and a replenisher of the bleach-fixing solution 220 for color paper in the color paper processing section 20. The amount of bleach-fixing solution replenished is thus reduced for the entire system and at the same time, an overflow of the bleach-fixing solution 220 is reused.

A bleaching ingredient is added to the overflow of the bleach-fixing solution 220 as often desired, typically in an amount of about 0.05 to 0.3 mol/liter. This is because the bleach-fixing solution for negative film S should generally contain more the bleaching ingredient than the bleach-fixing solution for color paper P. The bleaching ingredient can be introduced to the bleach-fixing solution 220 overflow by modifying the system such that an overflow from the bleaching tank 12 preceding the bleach-fixing tank 13 may merge with the bleach-fixing solution 220 overflow. Alternatively, a bleaching agent such as an ethylenediamine iron complex salt may be added directly to the bleach-fixing solution 220 overflow.

As the case may be, a fixing ingredient such as thiosulfate may be added to the bleach-fixing solution 220 overflow.

The amount of bleach-fixing solution replenished per total of a 135-size 24-frame color negative film and a corresponding color paper is about 30 to 80 ml compared to 60 to 110 ml required in the conventional system. This replenisher amount is about 30 to 80% of that of the prior art.

The reuse of bleach-fixing solution 220 can further improve the photographic properties of negative film and reduce the desilvering time.

It is unnecessary to specially prepare both a mother and a replenisher of the wash water 230 for color paper because an overflow of the wash water 140 for negative film is passed to the first washing tank 23. It is only necessary to prepare a mother and a replenisher of the wash water 140 for negative film in the negative film processing route 10. The amount of fresh replenisher water to be made up to the paper washing tank 25 can be reduced and at the same time, an overflow of the wash water 140 is reused.

The amount of wash water replenished per total of a 135-size 24-frame color negative film and a corresponding color paper is about 60 to 100 ml compared to 100 to 140 ml required in the conventional system. This replenisher water amount is about 40 to 80% of that of the prior art.

The water overflow may be directly fed to the paper washing tank 23. Suitable additives such as thiosulfates and sulfites may be added to the water overflow before entering the destined tank if desired, because such adjustment can improve dye permanence and film properties.

When two or more stages are provided for washing in the negative film processing route, better results are obtained by conducting an overflow of rinse water from the washing tank at the foremost stage of the negative film processing route to the washing tank at the foremost stage of the paper processing route. Conversely, less desirable results are obtained if an overflow of rinse water from the second or later stage washing tank of the negative film processing route is led to any washing step of the paper processing route, especially the second or later stage washing tank of the paper processing route.

In the illustrated embodiment, the process includes color development→bleaching→bleach fixation→water washing→drying for the negative film processing route 10, and contact printing→color development→bleach fixation →water washing→drying for the color paper processing route 20, and the negative and positive processes are consecutively carried out. However, the present invention is not limited to the illustrated embodiment. For example, the negative film processing route may be adapted to a process for a color reversal photosensitive material of the coupler-in-emulsion type, for example, including first development→water washing→color development→water washing→bleach-fixation→water washing→drying. Also, the color paper processing route may be adapted to a process for a color paper of the direct positive type, for example, including color development→bleach-fixation→stabilization→drying.

The step of "bleach-fixation" or "bleaching→bleach-fixation" used herein may include two separate steps of bleaching and fixation. Further, a process consisting of color development→bleach-fixation→water washing→drying may be employed for the negative film processing route of the illustrated embodiment.

Furthermore, the tanks and other components of the system can be arranged such that the negative film processing route may be adequately set up for either a negative film photosensitive material or a color reversal photosensitive material and the paper processing route may be adequately set up for either a color paper or a direct positive color paper.

The present invention in the first aspect is not limited to the above-mentioned embodiments insofar as the first route for processing a first photosensitive material and the second route for processing a second photosensitive material are disposed in juxtaposition and an overflow of a processing solution having a fixing function in the second route can be used as a mother or replenisher for a processing solution having a fixing function in the first route. For example, an embodiment is contemplated wherein only a processing tank having a fixing function is provided as separate tanks for the first and second color photosensitive materials while developing, washing and other tanks each are commonly used for both the materials.

In the preferred embodiment, the first color photosensitive material has at least one silver iodobromide emulsion layer, the second color photosensitive material has at least one silver chlorobromide or silver chloride emulsion layer, more preferably at least one silver chlorobromide emulsion layer containing at least 80 mol % of silver chloride, and a used one of the color developer for the first color photosensitive material is used as a mother or replenisher for the color developer for the second color photosensitive material. Various modifications can be made to this embodiment.

According to the present invention, a processing solution having a fixing function is transferred from the paper processing route to the negative film processing route as described above. If the processing solution were reversely transferred from the negative film processing route to the color paper processing route, the color paper would be insufficiently desilvered and stains would occur in unexposed areas. It is supposed that a component which has dissolved away from the negative film, for example, iodide ion ($I^-$) deleteriously affects the fixation of color paper.

The same problem occurs if a negative film and a color paper are subject to bleach-fixation in a common tank as disclosed in JP-A No. 169162/1987. The problem becomes worse with the progress of running operation.

The present invention in the second aspect is not limited to the above-mentioned embodiments insofar as the first route for processing a first photosensitive material and the second route for processing a second photosensitive material are disposed in juxtaposition and an overflow of wash water in the first route can be used as a mother or replenisher for wash water in the second route. For example, an embodiment is contemplated wherein only a washing tank is provided as separate tanks for the first and second color photosensitive materials while developing, fixing, and other tanks each are commonly used for both the materials. The number of washing tanks and the replenishment mode are not limited to the illustrated embodiments.

The washing step used herein is a step for removing chemical substances used in the preceding steps from the photosensitive material. Therefore, the term washing step encompasses stabilization and saved water washing as well, and the wash water or wash liquid is used to encompass all wash liquids for such purposes.

Preferably, an overflow of a processing solution having a fixing function in the second route is reused as a mother or replenisher for a processing solution having a fixing function in the first route.

In the preferred embodiment, the first color photo sensitive material has at least one silver iodobromide emulsion layer, the second color photosensitive material has at least one silver chlorobromide or silver chloride emulsion layer, more preferably at least one silver chlorobromide emulsion layer containing at least 80 mol % of silver chloride, and a used one of the color developer for the first color photosensitive material is used as a mother or replenisher for the color developer for the second color photosensitive material. Various modifications can be made to this embodiment.

According to the present invention, wash water is channeled from the negative film processing route (or first color photosensitive material processing route) to the color paper processing route (or second color photosensitive material processing route), thereby reducing the entire amount of wash water replenished to the negative film and color paper processing routes as compared with the prior art replenishment level while maintaining color image permanence and film properties. If the amount of wash water replenished is increased to the prior art replenishment level, substantial improvements are expected in color image permanence and film properties (e.g., reticulation, especially upon high-temperature drying). Little improvements are expected by increasing the amount of wash water replenished to the prior art replenishment level if the wash water is channeled in a reverse direction or if a common washing tank is used.

Although the printer 26 is provided in the illustrated embodiment, it is not necessarily required. An enlarger may be provided instead.

Developer

The color developer used herein is preferably an aqueous alkaline solution containing an aromatic primary amine color developing agent as a major ingredient. Aminophenol compounds are useful as the color developing agent although p-phenylenediamine compounds are preferably used. Typical examples of the p-phenylenediamine color developing agent include 3-methyl-4-amino-N,N-diethyl-aniline, 3-methyl-4-amino-N-ethyl-N-$\beta$-hydroxylethylaniline, 3-methyl-4-amino-N-ethyl-N$\beta$-methanesulfonamidoethylaniline, and 3-methyl-4-amino-N-ethyl-N$\beta$-methoxyethylaniline as well as sulfate, hydrochloride, phosphate, p-toluenesulfonate, tetraphenylborate, and p-(t-octyl)benzylsulfonate salts of the foregoing compounds. These diamines are generally more stable in salt form than in free form and thus preferably used in salt form.

Examples of the aminophenol derivatives include o-aminophenol, p-aminophenol, 4-amino-2-methylphenol, 2-amino-3-methylphenol, 3-oxy-3-amino-1;4-dimethylbenzene, etc.

Other useful color developing agents are those disclosed in L. F. A Mason, "Photographic Processing Chemistry," Focal Press, 1966, pages 226–229, U.S. Pat. Nos. 2,193,015 and 2,592,364, and JP-A No. 64933/1973. Two or more color developing agents may be used in combination, if desired.

The color developer may further contain pH buffer agents such as carbonate, borate and phosphate salts of alkali metals; development inhibitors or antifoggants such as bromides, iodides, benzimidazoles, benzothiazoles and mercapto compounds; preservatives such as hydroxylamine, triethanol amine, compounds as disclosed in West German OLS No. 2,622,950, sulfites, and bisulfites; organic solvents such as diethylene glycol; development accelerators such as benzyl alcohol, polyethylene glycol, quaternary ammonium salts, amines, thiocyanates, and 3,6-thiaoctane-1,8-diol; dye-forming couplers; competing couplers; nucleating agents such as sodium boron hydride; auxiliary developing agents such as 1-phenyl-3-pyrazolidone; thickeners; brighteners such as 4,4'-diamino-2,2'-disulfostilbene compounds; and chelating agents, for example, aminopolycarboxylic acids as typified by ethylenediaminetetraacetic acid, nitrilo triacetic acid, cyclohexanediaminetetraacetic acid, iminodiacetic acid, N-hydroxymethylethylenediaminetriacetic acid, diethylenetriaminepentaacetic acid, triethylenetetramine-hexaacetic acid, and the compounds disclosed in JP-A No. 195845/1983, 1-hydroxyethylidene-1,1'-diphosphonic acid, the organic phosphonic acids disclosed in Research Disclosure No. 18170 (May 1979), aminophosphonic acids such as aminotris(methylenephosphonic acid), ethylenediamine-N,N,N',N'-tetramethylenesulfonic acid, and phosphonocarobxylic acids such as disclosed in JP-A Nos. 102726/1977, 42730/1978, 121127/1979, 4024/1980, 4025/1980, 126241/1980, 65955/1980, and 65956/1980, and Research Disclosure No. 18170 (May 1979).

The color developing agent is generally used in a concentration of from about 0.1 to about 20 grams, preferably from about 0.5 to about 10 grams per liter of the color developer.

The color developer may have a pH of at least 7. It is generally used at about pH 9 to 13, more preferably at pH 9 to 11.

The color developer may be made up with a replenisher containing a halide, color developing agent and other agents in controlled concentrations, resulting in increased developing ability.

In a preferred embodiment of the present invention wherein the picture-taking color photosensitive material is processed with the color developer, the processing temperature is in the range of from 20° to 50° C., more preferably from 30° to 40° C. The processing time is in the range of from about 20 seconds to 10 minutes, more preferably from 30 seconds to 4 minutes. In processing color paper, the processing temperature is preferably in the range of from 30° to 48° C., more preferably 35° to 42° C. The temperature at which color paper is processed may be the same as that for the picture-taking color photosensitive material. The processing time is in the range of from about 20 seconds to 10 minutes, more preferably from 30 seconds to 4 minutes.

In processing color reversal photosensitive material, the processing temperature is in the range of from 33° to 50° C., preferably 38° to 45° C. and the processing time is in the range of from about 30 seconds to 10 minutes, preferably from 90 seconds to 8 minutes.

In processing direct positive type color paper, the processing temperature is in the range of from 33° to 50°

C., preferably 38° to 45° C. and the processing time is in the range of from about 30 seconds to 10 minutes, preferably from 90 seconds to 8 minutes.

Fixing solution

The bleaching or bleach-fixing solution used herein contains a bleaching agent, which is selected from ferric ion complexes and complexes of a ferric ion with chelating agents such as aminopolycarboxylic acids, aminopolphosphonic acids, and salts thereof. The aminopolycarboxylic acid salts and aminopolyphosphonic acid salts are salts of aminopolycarboxylic acids and aminopolyphosphonic acids with alkali metals, ammonium, and water-soluble amines. The alkali metals include sodium, potassium, and lithium, and the water-soluble amines include alkylamines such as methylamine, diethylamine, triethylamine, and butylamine, cycloaliphatic amines such as cyclohexylamine, aryl amines such as aniline and m-toluidine, and heterocyclic amines such as pyridine, morpholine, and piperazine.

Typical, but non-limiting, examples of the chelating agents in the form of aminopolycarboxylic acids, aminopolyphosphonic acids, and salts thereof include ethylene-diaminetetraacetic acid, disodium ethylenediaminetetraacetate, diammonium ethylenediaminetetraacetate, tetra-(trimethyammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrilotriacetate, cyclohexanediaminetetraacetic acid, disodium cyclohexanediaminetetraacetate, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, and 1,3-propylenediamine-N,N,N',N'-tetramethylenephosphonic acid.

The iron ion complex salts may be used in the form of a complex salt. Alternatively, a ferric salt such as ferric sulfate, ferric silver chloride, ferric nitrate, ferric sulfate ammonium, and ferric phosphate and a chelating agent such as an aminopolycarboxylic acid and phosphonocarboxylic acid may be used in a solution to form a ferric ion complex salt in the solution. In the former case, the complex salts may be used alone or in admixture of two or more. In the latter case where a ferric salt and a chelating agent are used to form a ferric ion complex salt in solution, a ferric salt or a mixture of two or more ferric salts may be used. In either case, the chelating agent may be used in excess than required to form the ferric ion complex salt. Aminopolycarboxylic acid iron complexes are preferred among the iron complexes. The amount of the ferric ion complex salt added is in the range of from 0.1 to 1 mol/liter, more preferably from 0.2 to 0.4 mol/liter of the bleaching solution, and in the range of from 0.05 to 0.5 mol/liter, more preferably from 0.1 to 0.3 mol/liter of the bleach. fixing solution for picture-taking color photographic photosensitive material as typified by color negative film. The amount of the ferric ion complex salt added is in the range of from 0.03 to 0.3 mol/liter, more preferably from 0.05 to 0.2 mol/liter of the bleaching or bleach-fixing solution for printing color photographic photosensitive material as typified by color paper.

The bleaching or bleach-fixing solution may contain a bleaching accelerator if desired. Examples of the useful bleaching accelerator include mercapto or disulfide group-containing containing compounds as described in U.S. Pat. No. 1,290,812, West German Pat. Nos. 1,290,812 and 2,059,988, JP-A Nos. 32736/1978, 57831/1978, 37418/1978, 65732/1978, 72623/1978, 95630/1978, 95631/1978, 104232/1978, 124424/1978, 141623/1978, and 28426/1978, and Research Disclosure No. 17129 (July 1978); thiazolidine derivatives as described in JP-A No. 140129/1975; thiourea derivatives as described in JP-B No. 8506/1970, JP-A Nos. 20832/1977 and 32735/1978, and U.S. Pat. No. 3,706,561; iodides as described in West German Pat. No. 1,127,715 and JP-A No. 16235/1983; polyethylene oxides as described in West German Pat. Nos. 966,410 and 2,748,430; polyamines as described in JP-B No. 8836/1970; compounds as described in JP-A Nos. 42434/1974, 59644/1974, 94927/1978, 35727/1979, 26506/1980, and 163940/1983; and iodide and bromide ions. Among these, the mercapto or disulfide group-containing compounds are preferred for increased accelerating effect, with the compounds described in U.S. Pat. No. 3,893,858, West German Pat. No. 1,290,812 and JP-A No. 95630/1978 being most preferred.

In addition, the bleaching or bleach-fixing solution used herein may contain a re-halogenating agent, for example, a bromide (e.g., potassium bromide, sodium bromide, and ammonium bromide), a chloride (e.g., potassium chloride, sodium chloride, and ammonium chloride), or an iodide (e.g., ammonium iodide).

One or more anti-corrosion agents may be added if desired, for example, inorganic acids, organic acids or alkali metal or ammonium salts thereof having pH buffering ability such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, and ammonium nitrate as well as guanidine.

The fixing agents used in the bleach-fixing or fixing solution used herein are well-known fixing agents. Examples of the fixing agent include water-soluble silver halide dissolving agents, for example, thiosulfates such as sodium thiosulfate and ammonium thiosulfate, thiocyanates, thioethers such as ethylene bisthioglycolic acid and 3,6-dithiaoctane-1,8-diol, and thioureas. The fixing agents may be used alone or in admixture of two or more. Also useful is a special bleach-fixing solution comprising a fixing agent as described in JP-A No. 155354/1976 combined with an excess amount of a halide such as potassium iodide.

In the practice of the invention, use of a thiosulfate, especially ammonium thiosulfate is preferred. The amount of the fixing agent used is preferably in the range of from 0.3 to 2 mol/liter of the bleach-fixing or fixing solution, especially in the range of from 0.8 to 1.5 mol/liter of the bleach-fixing or fixing solution for picture taking color photographic photosensitive material and in the range of from 0.5 to 1 mol/liter of the bleach-fixing or fixing solution for printing color photographic photosensitive material.

The bleach-fixing or fixing solution may preferably have a pH in the range of from 3 to 10, more preferably from 5 to 9. Lower pH levels can improve desilvering, but undesirably promote solution fatigue and conversion of cyan dyes into leuco form. Higher pH levels will retard desilvering and are likely to cause stains. For pH adjustment, hydrochloric acid, sulfuric acid, nitric acid, acetic acid, bicarbonates, ammonia, caustic potash, caustic soda, sodium carbonate, potassium carbonate or the like may be added if desired.

The bleach-fixing solution may additionally contain a variety of additives, for example, brighteners, defoaming agents or surface-active agents, and organic solvents such as polyvinyl pyrrolidone and methanol.

The bleach-fixing or fixing solution used herein may further contain preservatives in the form of sulfite ion-releasing compounds, for example, sulfites (e.g., sodium sulfite, potassium sulfite, ammonium sulfite, etc.), bisulfites (e.g., sodium bisulfite, potassium bisulfite, ammonium bisulfite, etc.), and metabisulfites (e.g., sodium metabisulfite, potassium metabisulfite, ammonium metabisulfite, etc.). These compounds are added in amounts of about 0.02 to 0.50 mol/liter, preferably 0.04 to 0.40 mol/liter of sulfite ion. Although sulfite salts are most often added as the preservative, ascorbic acid, carbonyl bisulfite adducts and carbonyl compounds may also be added.

Besides, buffering agents, brighteners, chelating agents, mildew proofing agents and the like may be added if desired.

A mixture of a bleaching solution and a fixing solution for picture-taking color photosensitive material may also be used as the bleach-fixing solution.

Wash water

In the practice of the present invention, the amount of wash water used in the washing step may be determined over a wide range by taking into account the properties of photo sensitive material to be processed (for example, dependent on the coupler or other agents used), water temperature, and other parameters. The wash water is preferably at pH 4 to 9, more preferably pH 5 to 8. The washing temperature and time may be suitably chosen in the range of from 20 seconds to 10 minutes at 15° to 45° C., more preferably in the range of from 30 seconds to 5 minutes at 25° to 45° C. though they depend on the properties of photosensitive material to be washed.

The stabilizing solution used in the stabilizing step which follows the washing step mentioned above or directly follows the bleach-fixation step without the washing step may contain a compound having an image stabilizing function. Examples of the stabilizing compound include aldehyde compounds, typically formalin, buffering agents for adjusting to a film pH level appropriate for dye stabilization, and ammonium compounds. In addition, the stabilizing bath may contain fungicidal agents, mildew-proofing agents, surface-active agents, brighteners, hardeners, chelating agents, and magnesium and bismuth compounds.

Photosensitive material

Next, the color photosensitive materials which are preferably processed by the system of the present invention are described.

The color photosensitive material which is processed by the color developer whose overflow is reused as a mother or replenisher of the color developer for the other color photosensitive material is preferably a picture taking color photosensitive material having at least one silver iodobromide emulsion layer.

The picture-taking color photosensitive material is not critical, but may be any well-known one. All commercially available picture-taking color negative films and reversal films are photosensitive materials having a silver iodobromide emulsion layer. For example, Fuji Color Super HR 1600 and Fuji Color Super HR 400 may be used. The silver iodobromide content is preferably at least 1 mol %, more preferably 3 to 20 mol %.

High sensitivity photosensitive materials having a sensitivity of higher than ISO 320 are more preferred. It is to be noted that the ISO sensitivity used herein is a specific photographic sensitivity as defined in JP-A No. 100453/1988. High sensitivity photosensitive materials having a sensitivity of higher than ISO 400 are most preferred.

The other color photosensitive material which is processed by the color developer which is provided in mother or replenisher form by the overflow of the color developer for the one color photosensitive material is preferably a color paper photosensitive material, having at least one silver chlorobromide or silver chloride emulsion layer.

The preferred color paper photosensitive material is a color printing photosensitive material having at least one silver chlorobromide or silver chloride emulsion layer having a silver chloride content of at least 80 mol % on a reflective support. More preferably, it is a color printing photosensitive material having at least one silver chlorobromide or silver chloride emulsion layer having a silver chloride content of at least 90 mol %, more preferably at least 95 mol %, most preferably 98 to 99.5 mol %. Such higher silver chloride contents are preferred for quickness of processing as well as photographic properties such as color balance and quality. Photosensitive material with such higher silver chloride contents can be developed at higher temperatures with lesser fog than in the prior art, resulting in quicker processing. However, the use of an all silver chloride emulsion is inconvenient in accomplishing high sensitivity and in preventing fog which would occur upon application of pressure to the photosensitive material The silver halide grains used herein may be core/shell grains having different phases in core and surface layers, multi-phase grains having a phase-to-phase junction structure, or uniform grains consisting of a homogeneous phase. A mixture of them is also included.

The silver halide grains used herein may preferably have a mean grain size of from 0.1 to 2 μm, more preferably 0.15 to 1.5 μm. (The mean grain size used herein is represented by an average based on projected areas corresponding to a grain diameter for spherical or near spherical grains, and a side length for cubic grains.) The grain size distribution may be either broad or narrow although a so-called mono-dispersed silver halide emulsion is preferably used wherein the standard deviation of its grain size distribution curve divided by the mean grain size (known as a percent grain size variation) is within 20%, most preferably within 15%. In order that the photo sensitive material meet the desired gradation, at least two mono-dispersed silver halide emulsions having different grain sizes (mono-dispersion being defined as having the above-defined percent grain size variation) may be mixed in a single layer or applied in separate neighboring layers for those emulsion layers having substantially the same photosensitivity. At least two multi-dispersed silver halide emulsions or a combination of a mono-dispersed emulsion and a multi-dispersed emulsion may be mixed in a single layer or applied in separate neighboring layers.

The silver halide grains used herein may have a regular crystalline shape such as cubic, octahedral, rhombic dodecahedral and tetradecahedral shapes or a mixture thereof, or a irregular crystalline shape such as a spherical shape, or a composite shape thereof. Plate grains are also contemplated. Emulsions in which plate grains having an aspect (length/thickness) ratio of at least 5, especially at least 8 occupy at least 50% of the total projection area may be used. Also useful are emulsions containing various crystalline shape grains in admixture. These emulsions may be either of the surface latent image type wherein latent images are predominantly formed at the surface or of the internal latent image type wherein latent images are predominantly formed in the interior.

The photographic emulsion used herein may be prepared by the methods described in Research Disclosure, Vol. 176, Item No. 17643 (I, II, III), December 1978.

The emulsion used herein is usually one which has been subjected to physical and chemical ripening and spectral sensitization. The additives used in these steps are described in Research Disclosure, Vol. 176, Item No. 17643, December 1978 and ibid., Vol. 187, Item No. 18716, November 1979. They are listed in the following table together with the pages to be referred to in the literature. Letters R and L mean right and left columns of the page. These well-known photographic additives may be used for the emulsion associated with the photosensitive material to be processed according to the present invention.

| Additive | RD17643 | RD18716 |
|---|---|---|
| 1. Chemical sensitizer | 23 | 648R |
| 2. Sensitivity increasing agent | 23 | 648R |
| 3. Spectral sensitizer/ Supersensitizer | 23–24 | 648R–649R |
| 4. Brightener | 24 | |
| 5. Antifoggant/stabilizer | 24–25 | 649R |
| 6. Coupler | 25 | |
| 7. Organic solvent | 25 | |
| 8. Light absorber/filter dye/ UV absorber | 25–26 | 649R–650L |
| 9. Anti-staining agent | 25R | 650L-R |
| 10. Dye image stabilizing agent | 25 | |
| 11. Hardener | 26 | 651L |
| 12. Binder | 26 | 651L |
| 13. Plasticizer/lubricant | 27 | 650R |
| 14. Coating aid/surfactant | 26–27 | 650R |
| 15. Antistatic agent | 27 | 650R |

For the color paper photosensitive material used herein, a variety of color couplers may be employed. By the term coupler used herein is meant a compound capable of coupling reaction with an oxidant of an aromatic primary amine developing agent to form a dye. Typical examples of the useful color coupler include naphthol and phenol compounds, pyrazolone and pyrazoloneazole compound, and open ring and heterocyclic ketomethylene compounds. Examples of these cyan, magenta, and yellow couplers used herein are described in the patents cited in Research Disclosure, RD17643, item VII-D, December 1978, and ibid., RD 18717, November 1979.

The color couplers incorporated in the photosensitive materials preferably have a ballast group or be polymerized to be fast to diffusion. As compared to four equivalent color couplers having a hydrogen atom at their active coupling site, two equivalent color couplers having a coupling-off group replaced at their active coupling site are advantageous in reducing the amount of silver coated. Also useful are couplers capable of producing a color developing dye having a moderate degree of diffusion, colorless couplers, DIR couplers releasing a development inhibitor upon coupling reaction, and couplers releasing a development accelerator.

The yellow couplers used herein are typically acylacetamide couplers of the oil protect type Their examples are described in U.S. Pat. Nos. 2,407,210, 2,875,057, and 3,265,506, inter alia. Two equivalent yellow couplers are preferred for the present invention, and typical examples thereof include yellow couplers of the oxygen atom releasing type as described in U.S. Pat. Nos. 3,408,194, 3,447,928, 3,933,501, and 4,022,620, and yellow couplers of the nitrogen atom releasing type as described in JP-B No. 10739/1980, U.S. Pat. Nos. 4,401,752 and 4,326,024, RD 18053 (April 1979), British Pat. No. 1,425,020, West German OSL Nos. 2,219,917, 2,261,361, 2,329,587, and 2,433,812. Among others, α-pivaloylacetanilide couplers can produce color developing dyes having excellent fastness, especially light fastness and α-benzoylacetanilide couplers accomplish a high density of color development.

The magenta couplers used herein are typically indazolone and cyanoacetyl couplers of the oil protect type, with 5-pyrazolone couplers and pyrazoloazole couplers such as pyrazolotriazole couplers being preferred. Among the 5-pyrazolone couplers, those couplers having an arylamino or acylamino group substituted at the 3-position are preferred for hue and color development density of the resulting color developing dye, with typical examples being described in U.S. Pat. Nos. 2,311,082, 2,343,703, 2,600,788, 2,908,573, 3,062,653, 3,152,896, and 3,936,015. The two equivalent 5-pyrazolone couplers preferably have a coupling-off group in the form of a nitrogen atom coupling-off group as described in U.S. Pat. No. 4,310,619 or an arylthio group as described in U.S. Pat. No. 4,351,897. Also 5-pyrazolone couplers having a ballast group as described in European Pat. No. 73,636 accomplish a high density of color development. U The pyrazoloazole couplers include the pyrazolone benzimidazoles described in U.S. Pat. No. 3,369,879, pyrazolo[5,1,-c][1,2,4]triazoles described in U.S. Pat. No. 3,725,067, and pyrazotetrazoles described in Research Disclosure RD 24220, June 1984. The imidazo[1,2,-b]-pyrazoles pyrazoles described in European Pat. No. 119,741 are preferred for minimal yellow sub-absorption and increased light fastness of the resulting color developing dye, with the pyrazolo[1,5,-b][1,2,4]triazoles described in European Pat. No. 119,860 being most preferred.

The cyan couplers used herein are typically naphthol and phenolic couplers of the oil protect type. Their examples include naphthol couplers as described in U.S. Pat. No. 2,474,293, typically two equivalent naphthol couplers of the oxygen atom releasing type as described in U.S. Pat. Nos. 4,052,212, 4,146,396, 4,228,233, and 4,296,200. Cyan couplers which are fast to humidity and temperature are preferably used herein, and their typical examples include phenolic cyan couplers having an alkyl group higher than ethyl group at the meta position of the phenol nucleus as described in U.S. Pat. No. 3,772,002, 2,5-diacylamino substituted phenolic couplers as described in U.S. Pat. Nos. 2,772,162, 3,758,308, 4,126,396, 4,334,011, and 4,327,173, West German OSL No. 3,329,729, and JP-A No. 166956/1984, and phenolic couplers having a phenyl ureido group at the 2-position and an acylamino group at the 5-position as described in U.S. Pat. Nos. 3,446,622, 4,333,999, 4,451,559, and 4,427,767.

A coupler producing a color developing dye having a moderate degree of diffusion may be used in combination to improve graininess. Such dye diffusing couplers are described in U.S. Pat. No. 4,366,237 and British Pat. No. 2,125,570 for magenta couplers and in European Pat. No. 96,570 and West German OSL No. 3,234,533 for yellow, magenta, and cyan couplers. Dye-forming couplers and the above-mentioned special couplers may form dimers or higher polymers. Typical examples of the polymerized dye-forming couplers are described in U.S. Pat. Nos. 3,451,820 and 4,080,211. Typical examples of the polymerized magenta couplers are described in British Pat. No. 2,102,173 and U.S. Pat. No. 4,367,282.

In order to meet the characteristics required for the photosensitive material, the couplers mentioned above may be used as a mixture of two or more in a common layer among photosensitive layers or the same compound may be introduced in two or more layers among photosensitive layers.

The couplers used herein may be introduced into the photosensitive material by any of well-known dispersion methods. For example, an oil-in-water dispersion method uses organic solvents, typically high-boiling organic solvents as described in U.S. Pat. No. 2,322,027. A latex dispersion method which is a modified polymer dispersion method is described with respect to its steps, benefits, and impregnating latex in U.S. Pat. No. 4,199,363, and West German OSL Nos. 2,541,274 and 2,541,230. Organic solvent soluble polymers are described in PCT Application JP No. 87/00492.

The above-mentioned oil-in-water dispersion method may use other organic solvents, for example, alkyl phthalates (e.g., dibutyl phthalate and dioctyl phthalate), phosphates (e.g., diphenyl phosphate, triphenyl phosphate, and tricresyl phosphate), citrates (e.g., tributyl acetylcitrate), benzoates (e.g., octyl benzoate), alkyl amides (e.g., diethyllaurylamide), aliphatic esters (e.g., dibutoxyethyl succinate and diethyl acetate), trimesate (e.g., tributyl trimesate) as well as organic solvents having a boiling point of 30° to 150° C., for example, lower alkyl acetates such as ethyl acetate and butyl acetate, ethyl propionate, sec.-butyl alcohol, methyl isobutyl ketone, β-ethoxyethyl acetate, methyl cellosolve acetate, and a mixture thereof.

According to the standard practice, the color couplers are used in an amount of from about 0.001 to about 1 mol per mol of photosensitive silver halide, preferably in the range of from 0.01 to 0.5 mol for yellow couplers, in the range of from 0.003 to 0.3 mol for magenta couplers, and in the range of from 0.002 to 0.3 mol for cyan couplers.

The color paper photosensitive material used herein generally includes a reflective support. The "reflective support" serves to make clear dye images formed in the silver halide emulsion layer and includes flexible supports such as plastic films (e.g., cellulose nitrate, cellulose acetate, and polyethylene terephthalate) and paper and rigid supports such as glass, both coated with a hydrophobic resin having a light reflective material (e.g., titanium oxide, zinc oxide, calcium carbonate, and calcium sulfate) dispersed therein. The photosensitive emulsion is coated on the reflective support. With respect to the support and the coating technique, reference is made to Research Disclosure Vol. 176, Item No. 17643, XV (page 27) and XVII (page 28), December 1978.

All the U.S. patents are incorporated herein by reference.

The present invention makes it possible to reduce the make-up amount of a processing solution having a fixing function, typically a bleach-fixing solution and to reuse an overflow of a processing solution having a fixing function while maintaining good photographic properties. The present invention also makes it possible to reduce the make-up amount of a color developer and to reuse an overflow of a color developer.

The present invention further makes it possible to reduce the make-up amount of wash water and to reuse an overflow of wash water while maintaining good photographic properties.

The system of the present invention requires a reduced space for installation.

EXPERIMENTS

In order to demonstrate how the system of the present invention is effective in processing color photosensitive materials, several experiments were conducted which are given below by way of illustration and not by way of limitation.

Experiment 1

Preparation of color paper A

A multi-layer photographic color paper sheet designated color paper A was prepared from a paper support having both sides laminated with polyethylene by coating it with the following coating compositions in the layer arrangement shown below.

The coating composition was prepared as follows.

Preparation of first layer coating composition

In 27.2 ml of ethyl acetate and 7.7 ml (8.0 grams) of high-boiling solvent (Solv-1) were dissolved 19.1 grams of yellow coupler (ExY-1) and 4.4 grams of color image stabilizer (Cpd-1). The solution was dispersed and emulsified in 185 ml of 10% gelatin aqueous solution containing 8 ml of 10% sodium dodecylbenzene sulfonate solution. The emulsified dispersion was mixed with emulsions EM1 and EM2. The resulting solution was adjusted for gelatin concentration so as to give the composition shown below, obtaining a first layer coating composition.

Coating compositions for second to seventh layers were prepared by substantially the same procedure as described for the first layer.

The gelatin hardener used in each layer was 1-oxy-3,5-dichloro-s-triazine sodium salt. The thickener used was (Cpd-14).

Layer arrangement

Each of the layers has the composition shown below. That is, ingredients and their amounts coated are shown below for each layer. The amount of each ingredient coated is expressed in gram per square meter ($g/m^2$) unit except that the amount of silver halide emulsion coated is expressed by calculating the amount of silver coated.

---

Support

Polyethylene laminated paper with the polyethylene layer on the first layer side containing white pigment -continued

| | |
|---|---|
| ($TiO_2$) and a blue-tinting dye. | |
| First layer: blue-sensitive layer | |
| Monodispersed silver chlorobromide emulsion (EM1) spectrally sensitized with sensitizing dye (ExS-1) | 0.15 |
| Monodispersed silver chlorobromide emulsion (EM2) spectrally sensitized with sensitizing dye (ExS-1) | 0.15 |
| Gelatin | 1.86 |
| Yellow coupler (ExY-1) | 0.82 |
| Color image stabilizer (Cpd-1) | 0.19 |
| Solvent (Solv-1) | 0.35 |
| Second layer: Anti-color-mixing layer | |
| Gelatin | 0.99 |
| Anti-color-mixing agent (Cpd-2) | 0.08 |
| Third layer: green-sensitive layer | |
| Monodispersed silver chlorobromide emulsion (EM3) spectrally sensitized with sensitizing dyes (ExS-2) and (ExS-3) | 0.12 |
| Monodispersed silver chlorobromide emulsion (EM4) spectrally sensitized with sensitizing dyes (ExS-2) and (ExS-3) | 0.24 |
| Gelatin | 1.24 |
| Magenta coupler (ExM-1) | 0.39 |
| Color image stabilizer (Cpd-3) | 0.25 |
| Color image stabilizer (Cpd-4) | 0.12 |
| Solvent (Solv-2) | 0.25 |
| Fourth layer: UV absorbing layer | |
| Gelatin | 1.60 |
| UV absorbers (Cpd-5/Cpd-6/Cd-7 = 3/2/6 in weight ratio) | 0.70 |
| Anti-color-mixing agent (Cpd-8) | 0.05 |
| Solvent (Solv-3) | 0.42 |
| Fifth layer: red-sensitive layer | |
| Monodispersed silver chlorobromide emulsion (EM5) spectrally sensitized with sensitizing dyes (ExS-4) and (ExS-5) | 0.07 |
| Monodispersed silver chlorobromide emulsion (EM6) spectrally sensitized with sensitizing dyes (ExS-4) and (ExS-5) | 0.16 |
| Gelatin | 0.92 |
| Cyan coupler (ExC-1) | 1.46 |
| Cyan coupler (ExC-2) | 1.84 |

-continued

| | |
|---|---|
| Color image stabilizers (Cpd-5/Cpd-6/Cd-7 = 3/4/2 in weight ratio) | 0.17 |
| Dispersing polymer (Cpd-9) | 0.14 |
| Solvent (Solv-1) | 0.20 |
| Sixth layer: UV absorbing layer | |
| Gelatin | 0.54 |
| UV absorbers (Cpd-5/Cpd-6/Cd-7 = 1/5/3 in weight ratio) | 0.21 |
| Solvent (Solv-4) | 0.08 |
| Seventh layer: protective layer | |
| Gelatin | 1.33 |
| Acryl-modified polyvinyl alcohol copolymer (modification 17%) | 0.17 |
| Liquid paraffin | 0.03 |

The anti-irradiation dyes used were (Cpd-10) and (Cpd-11). Each photosensitive layer further contained Alkanol XC (manufactured by E. I. duPont) and sodium alkylbenzene sulfonate as emulsification/dispersion aids, and succinate ester and Magefacx F-120 (manufactured by Dai-Nihon Ink K.K.) as coating aids. Stabilizers (Cpd-12) and (Cpd-13) were used for stabilizing silver halide.

The emulsions used had the following characteristics.

| Designation | Shape | Grain size (μm) | Br content (mol %) | Coefficient of variation* |
|---|---|---|---|---|
| EM1 | cubic | 1.1 | 1.0 | 0.10 |
| EM2 | cubic | 0.8 | 1.0 | 0.10 |
| EM3 | cubic | 0.45 | 1.5 | 0.09 |
| EM4 | cubic | 0.34 | 1.5 | 0.09 |
| EM5 | cubic | 0.45 | 1.5 | 0.09 |
| EM6 | cubic | 0.34 | 1.6 | 0.10 |

*Coefficient of variation represents the distribution of grains in terms of the standard deviation divided by mean grain size.

The compounds used herein are identified below.

ExY-1

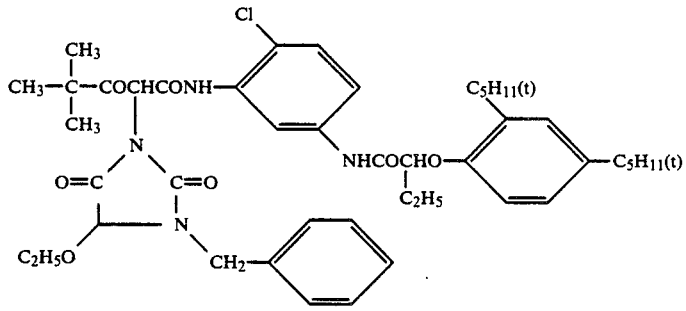

ExM-1

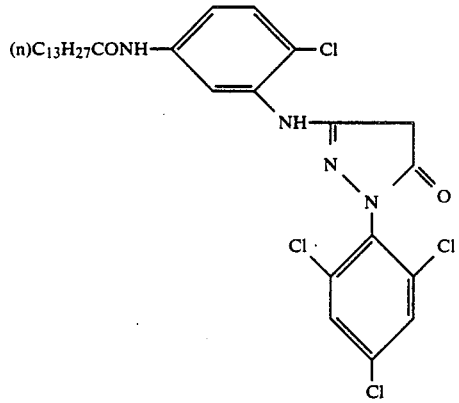

-continued
ExC-1
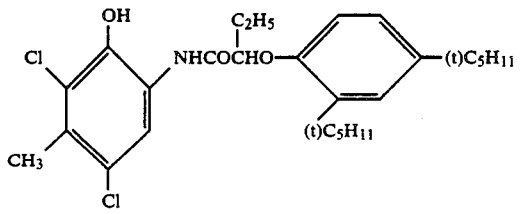
ExC-2
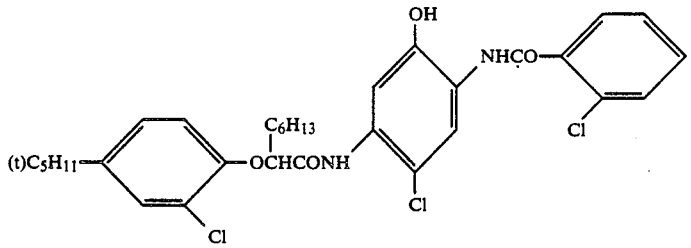
ExS-1
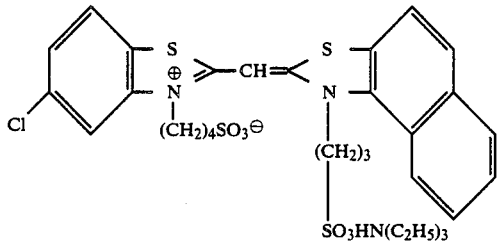
ExS-2
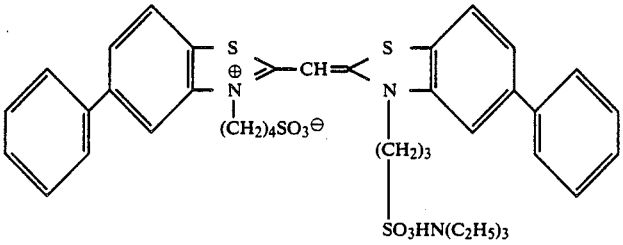
ExS-2
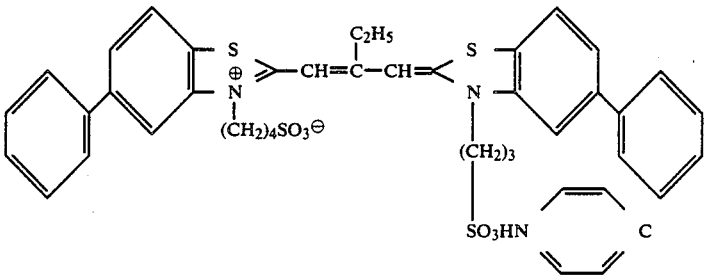
ExS-4
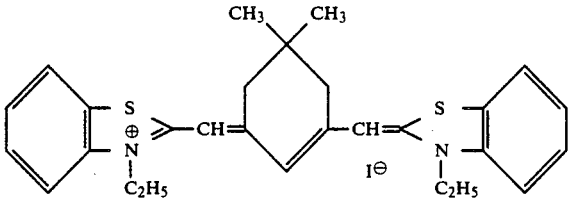

-continued
ExS-5
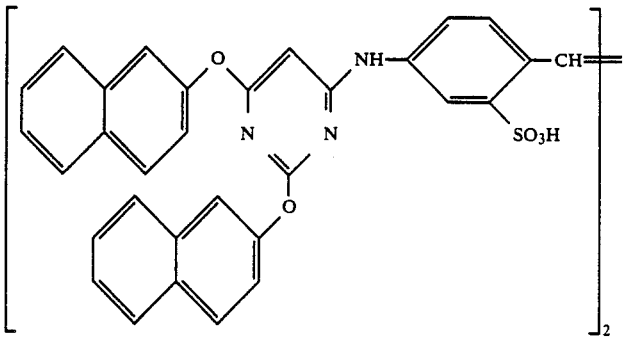
Cpd-1
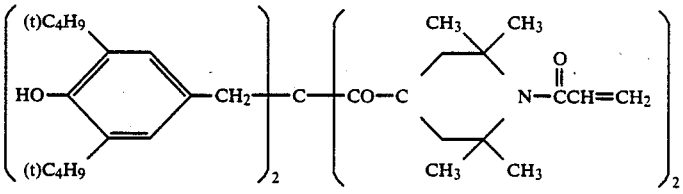
Cpd-2
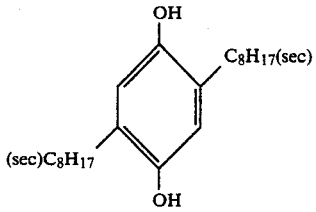
Cpd-3
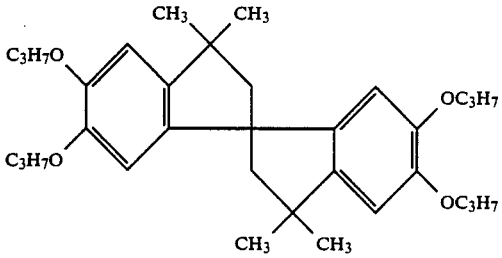
Cpd-4
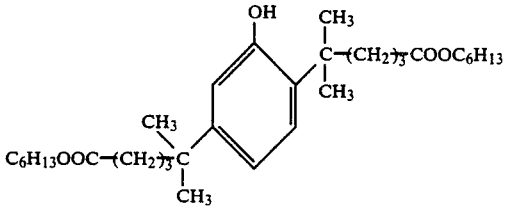
Cpd-5
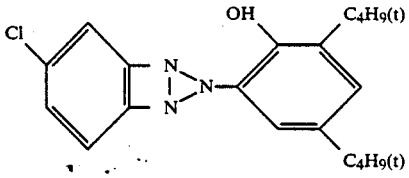
Cpd-6
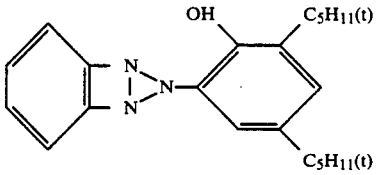

-continued
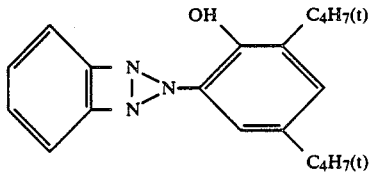
Cpd-7
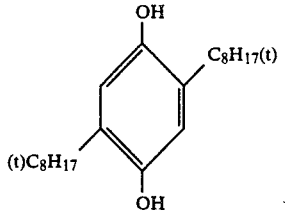
Cpd-8
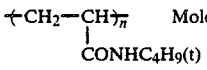
Molecular weight of about 60,000
Cpd-9
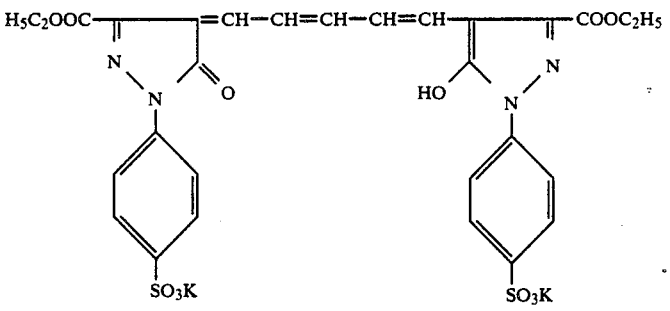
Cpd-10
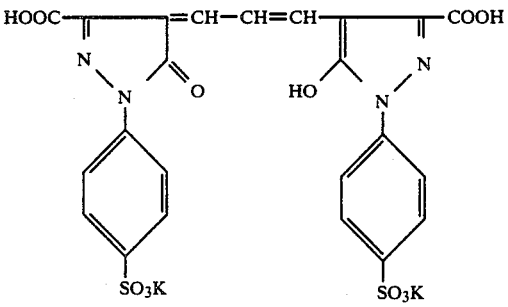
Cpd-11
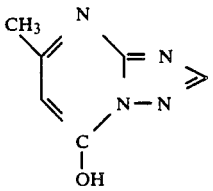
Cpd-12
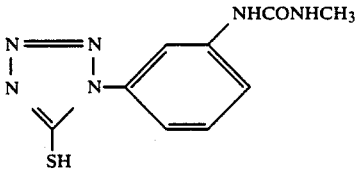
Cpd-13

-continued

Cpd-14

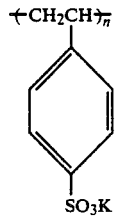

Solv-1: dibutyl phthalate
Solv-2: trioctyl phosphate
Solv-3: trinonyl phosphate
Solv-4: tricresyl phosphate Using the photosensitive material processing system schematically shown in FIGS. 1*a*, 1*b*, and 1*c*, a color negative film (Fuji Color Super HR 1600 manufactured by Fuji Photo Film Co. Ltd., Japan) in which pictures had been taken at night using a strobe and the above-prepared color paper were processed. The processing steps and the processing formulations are shown below.

| | Color negative film Processing | | |
|---|---|---|---|
| Step | Time | Temp. | Replenishment* |
| Color development | 3'15" | 38° C. | 45 ml |
| Bleaching | 1'00" | 38° C. | 20 ml |
| Bleach-fixing | 3'15" | 38° C. | 75 ml (from bleach-fixing tank for color paper) 21 ml (from bleaching tank for negative film) |
| First washing | 40" | 35° C. | — |
| Second washing | 1'00" | 35° C. | 30 ml |
| Drying | 1'15" | 55° C. | |

*The amount of replenisher is per 135-size 24-frame color negative film.

Water washing was carried out in a two tank counterflow mode by passing wash water from the second to the first washing tank. An overflow of the bleaching solution was channeled to the bleach fixing tank in the same negative film processing route.

Each processing solution had the following composition.

| Color Developing solution Ingredients | Mother | Replenisher |
|---|---|---|
| Diethylenetriaminepentaacetatic acid | 1.0 g | 1.0 g |
| 1-hydroxyethylidene-1,1-diphosphonic acid | 3.0 g | 4.0 g |
| Sodium sulfite | 4.0 g | 5.5 g |
| Potassium carbonate | 30.0 g | 45.0 g |
| Potassium bromide | 1.4 g | 0.7 g |
| Potassium iodide | 1.5 mg | 0 g |
| Hydroxylamine hydrogen sulfate | 2.4 g | 3.2 g |
| 4-(N-ethyl-N-β-hydroxyethylamino)-2-methylaniline hydrogen sulfate | 4.5 g | 5.3 g |
| Water totaling to | 1000 ml | 1000 ml |
| pH | 10.05 | 10.25 |

Bleaching solution (common to mother and replenisher)

| Ingredients | |
|---|---|
| Ferric ethylenediaminetetraacetate ammonium dihydrate | 120.0 g |
| Disodium ethylenediaminetetraacetate | 10.0 g |
| Ammonium bromide | 100.0 g |
| Ammonium nitrate | 10.0 g |
| Bleach accelerator | 0.005 mol |

-continued

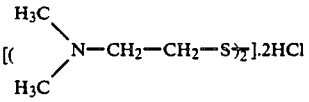

| | |
|---|---|
| Aqueous ammonia (27%) | 15.0 ml |
| Water totaling to | 1000 ml |
| pH | 6.3 |

Bleach-fix solution (common to mother and replenisher)

It was prepared by adding 100 ml of 70% ammonium thiosulfate and 70 grams of iron (III) 1,3-diethylene-triaminepentaacetate ammonium (1,3-DTPA-Fe) to 1 liter of an overflow of the color paper bleach-fixing solution having the formulation shown later.

Wash water (common to mother and replenisher)

City water was passed through a mixed bed column filled with H type strong acidic cation-exchange resin (Amberlite IR-120B manufactured by Rohm & Haas) and OH type anion-exchange resin (Amberlite IR-400) to calcium and magnesium ion concentrations of each up to 3 mg/liter. Then 20 mg/liter of sodium dichloroisocyanurate and 150 mg/liter of sodium sulfate were added to ion exchanged water. The water was in the range of pH 6.5 to 7.5.

| | Color paper Processing | | |
|---|---|---|---|
| Step | Time | Temp. | Replenishment (/m$^2$) |
| Color development | 45" | 38° C. | 190 ml (from developing tank for negative film) |
| Bleach-fixing | 45" | 38° C. | 215 ml |
| First washing | 30" | 38° C. | — |
| Second washing | 30" | 38° C. | — |
| Third washing | 30" | 38° C. | 248 ml |
| Drying | 60" | 85° C. | |

Water washing was carried out in a three tank counterflow mode by passing wash water from the third to the second to the first washing tank.

Each processing solution had the following composition.

Color Developing solution (common to mother and replenisher)

An overflow of the color developing solution for color negative film was used as such.

Bleach-fix solution (common to mother and replenisher)

| Ingredients | |
|---|---|
| Water | 400 ml |
| Ammonium thiosulfate (70%) | 100 ml |
| Sodium sulfite | 17 g |
| Iron (III) 1,3-diethylenetriamine-pentaacetate ammonium | 55 g |
| Disodium ethylenediaminetetraaacetate | 5 g |
| Ammonium bromide | 40 g |
| Glacial acetic acid | 9 g |
| Water totaling to | 1000 ml |
| pH (25° C.) | 5.40 |
| Wash water (common to mother and replenisher) | |
| Ion-exchanged water | |
| (calcium and magnesium contents each up to 3 ppm) | |

A series of color prints were finished by conducting running operation in the above-described way. The color prints showed good gradation balance and photographic properties. No bleach-fixing stains were observed to occur on the color negative film immediately after processing.

In a comparative run where an overflow of the bleach-fixing solution from the negative film bleach-fixing tank was channeled to the color paper bleach-fixing tank, the color paper was found to be insufficient in desilvering and leave stains in unexposed areas. In another comparative run where a color negative film and a color paper were processed in a common bleach-fixing tank according to the method described in JP-A No. 169162/1987, the same problems as above occurred and became serious as the running operation proceeded.

As compared with the prior art technique wherein the color developer and the bleach-fixing solution are replenished separately for negative film processing and color paper processing, the present invention could reduce the amount of replenishment for the color developer to 40 to 65% and the amount of replenishment for the bleach-fixing solution to 30 to 80%.

It becomes possible that an overflow of the color developer in the negative film processing route by used as the color developer in the color paper processing route instead of a mother therefor and that an overflow of the bleach-fixing solution in the color paper processing route be used as the bleach-fixing solution in the negative film processing route instead of a mother therefor.

Experiment 2

The procedure of Experiment 1 was repeated except that wash water overflow was channeled from the negative film first washing tank to the color paper first washing tank. The following modifications were made to the negative film and color paper processing steps.

| Color negative film Processing | | | |
|---|---|---|---|
| Step | Time | Temp. | Replenishment* |
| Color development | 3'15" | 38° C. | 45 ml |
| Bleaching | 1'00" | 38° C. | 20 ml |
| Bleach-fixing | 3'15" | 38° C. | 34.7 ml (from bleach-fixing tank for color paper)<br>20 ml (from bleaching tank for negative film) |
| First washing | 40" | 35° C. | — |
| Second washing | 1'00" | 35° C. | 30 ml |

-continued

| Color negative film Processing | | | |
|---|---|---|---|
| Step | Time | Temp. | Replenishment* |
| Drying | 1'15" | 55° C. | |

*The amount of replenisher is per 135-size 24-frame color negative film.

Water washing was carried out in a two tank counterflow mode by passing wash water from the second to the first washing tank. An overflow of the bleaching solution was channeled to the bleach-fixing tank in the same negative film processing route.

| Color paper Processing | | | |
|---|---|---|---|
| Step | Time | Temp. | Replenishment (/m$^2$) |
| Color development | 45" | 38° C. | 190 ml (from developing tank for negative film) |
| Bleach-fixing | 45" | 38° C. | 215 ml |
| First washing | 30" | 38° C. | 127 ml (from first washing tank for negative film) |
| Second washing | 30" | 38° C. | — |
| Third washing | 30" | 38° C. | 248 ml |
| Drying | 60" | 85° C. | |
| Wash water for color paper | | | |
| First wash water (common to mother and replenisher) | | | |
| An overflow from the first washing tank for the negative film was used. | | | |
| Second and third wash water (common to mother and replenisher) | | | |
| Ion-exchanged water (calcium and magnesium contents each up to 3 ppm) | | | |

A series of color prints were finished by conducting running operation by the same procedure as in Experiment 1. The color prints showed good gradation balance and photographic properties. Stickiness was satisfactory and no reticulation occurred. No bleach-fixing stains were observed to occur on the color negative film immediately after processing.

The color prints were stored for 3 days at 40° C. and RH 80%. Thereafter, they were examined for stain occurrence and color image fading, which were found to fall within the acceptable level.

In comparative runs where the wash water overflow was channeled in a reverse direction to the presently defined direction and where a common washing tank was used, color image stability and film properties were inferior.

As compared with the prior art technique wherein the color developer, bleach-fixing solution, and wash water are replenished independently for negative film processing and color paper processing, the present invention could reduce the amount of replenishment for the color developer to 40 to 65%, the amount of replenishment for the bleach-fixing solution to 30 to 80%, and the amount of replenishment for the wash water to 40 to 80%.

It becomes possible that overflows of the color developer and wash water in the negative film processing route be used as the color developer and wash water in the color paper processing route instead of mothers therefor, respectively, and that an overflow of the bleach-fixing solution in the color paper processing route be used as the bleach-fixing solution in the negative film processing route instead of a mother therefor.

Equivalent results were obtained when the wash water used in the negative film processing route was replaced by a stabilizing liquid containing formalin in water.

Obviously many variations and modifications of the present invention are possible in the light of the above teachings. It is therefore to be understood that within the scope of the appended claims, the invention may be practiced otherwise than as specifically described.

What is claimed:

1. In a system for wet processing an exposed silver halide color photosensitive material by carrying the photosensitive material along a processing route including a developing tank and a processing tank having a fixing function, the improvement comprising:

a first processing route for a first color photosensitive material including a first developing tank containing color developing solution and a first processing tank containing processing solution having a fixing function, and a second processing route for a second color photosensitive material including a second developing tank containing color developing solution and a second processing tank containing processing solution having a fixing function, said first and second processing routes being arranged in juxtaposition, and transfer means for passing said processing solution from said second processing tank to said first processing tank.

2. The photosensitive material processing system of claim 1, wherein said first color photosensitive material has at least one silver iodobromide emulsion layer and said second photosensitive material has at least one silver chlorobromide or silver chloride emulsion layer, and the system further includes a transfer means for passing color developing solution from said first developing tank to said second developing tank.

3. In a system for wet processing an exposed silver halide color photosensitive material by carrying the photosensitive material along a processing route including a developing tank, a processing tank having a fixing function, and a water washing tank, the improvement comprising:

a first processing route for a first color photosensitive material including a first washing tank containing wash liquid, and a second processing route for a second color photosensitive material including a second washing tank containing wash liquid, said first and second processing routes being arranged in juxtaposition, and transfer means for passing wash liquid from said first washing tank to said second processing tank.

4. The photosensitive material processing system of claim 3, wherein said first processing route further comprises a first developing tank containing color developing solution and a first processing tank containing processing solution having a fixing function, and said second processing route further comprises a second developing tank containing color developing solution and a second processing tank containing processing solution having a fixing function, and the system further comprises a second transfer means for passing processing solution from said second processing tank to said first processing tank.

5. The photosensitive material processing system of claim 4, wherein said first color photosensitive material has at least one silver iodobromide emulsion layer and said second photosensitive material has at least one silver chlorobromide or silver chloride emulsion layer, and the system further comprises a transfer means for passing color developing solution from said first developing tank to said second developing tank.

6. A system for wet processing an exposed silver halide color photosensitive material by carrying the photosensitive material along a processing route including a developing tank, a processing tank having a fixing function, and a water washing tank, the improvement comprising:

a first processing route for a first color photosensitive material including at least a first fore stage washing tank containing wash liquid and a first aft stage washing tank containing wash liquid;

a second processing route for a second color photosensitive material including at least a second fore stage washing tank containing wash liquid and a second aft stage washing tank containing wash liquid, said first and second processing routes being arranged in juxtaposition; and transfer means for passing wash liquid from said first fore stage washing tank to said second fore stage washing tank.

* * * * *